US009739103B2

(12) United States Patent
Nyström et al.

(10) Patent No.: US 9,739,103 B2
(45) Date of Patent: Aug. 22, 2017

(54) METHOD FOR A DRILL SUPPORT ARRANGEMENT, DRILL SUPPORT ARRANGEMENT, VEHICLE COMPRISING A DRILL SUPPORT ARRANGEMENT AND COMPUTER PROGRAM PRODUCT

(71) Applicant: Atlas Copco Rock Drills AB, Orebro (SE)

(72) Inventors: Sven-Olov Nyström, Orebro (SE); Jan Olsson, Orebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 226 days.

(21) Appl. No.: 14/421,898

(22) PCT Filed: Aug. 26, 2013

(86) PCT No.: PCT/SE2013/050997
§ 371 (c)(1),
(2) Date: Feb. 16, 2015

(87) PCT Pub. No.: WO2014/035318
PCT Pub. Date: Mar. 6, 2014

(65) Prior Publication Data

US 2015/0218896 A1 Aug. 6, 2015

(30) Foreign Application Priority Data

Aug. 30, 2012 (SE) ..... 1250970

(51) Int. Cl.
*E21B 19/18* (2006.01)
*E21D 20/00* (2006.01)
(Continued)

(52) U.S. Cl.
CPC ..... *E21B 19/18* (2013.01); *E21B 3/02* (2013.01); *E21B 7/02* (2013.01); *E21B 41/0092* (2013.01); *E21D 20/006* (2013.01)

(58) Field of Classification Search
CPC ..... E21B 19/00; E21B 19/14; E21B 19/146; E21B 19/15; E21B 19/16; E21B 19/165;
(Continued)

(56) References Cited

U.S. PATENT DOCUMENTS
2,333,487 A 11/1943 Nast
2,350,658 A 6/1944 Curtis
(Continued)

FOREIGN PATENT DOCUMENTS
CN 201288523 8/2009
CN 102216555 10/2011
(Continued)

*Primary Examiner* — Brad Harcourt
(74) *Attorney, Agent, or Firm* — Mark P. Stone

(57) ABSTRACT

The invention relates to a method pertaining to a drill support device (290) comprising two relatively movable drill support arms (241; 242), wherein a support space is formed between opposite arm sections (261, 262), in which a drill steel (201) is adapted to be guided and wherein said space is opened and closed by relative displacement of said sections (261, 262). The method includes the step of: —fixing (S401) at least one of said drill support arms (241; 242) by sealingly clamping between, on one side, a support element (670) and, on the other side, a housing section (650), which accommodates a hydraulic cylinder (605) with a hydraulic piston (680), on which hydraulic cylinder (605), said drill support arm (241; 242) is revolvingly mounted, wherein said drill support arm (241; 242) is clamped by means of a screw means (640) by which the housing section (650) is displaceable. The invention also relates to a computer program product comprising program code (P) for a computer (200; 210) for implementing a method according to the invention. The invention also relates to a drill support device (290) and a vehicle (100) equipped with the drill support device (290).

20 Claims, 6 Drawing Sheets

(51) Int. Cl.

| | |
|---|---|
| ***E21B 3/02*** | (2006.01) |
| ***E21B 7/02*** | (2006.01) |
| ***E21B 41/00*** | (2006.01) |

(58) Field of Classification Search
CPC . E21B 19/20; E21B 19/18; E21B 3/02; E21B 41/0092; E21B 7/02; E21D 20/006
See application file for complete search history.

(56) References Cited

U.S. PATENT DOCUMENTS

| | | | |
|---|---|---|---|
| 2,648,523 | A | 8/1953 | Osgood |
| 3,231,318 | A | 1/1966 | Ytterfors |
| 4,096,608 | A | 6/1978 | Lagerstedt |

FOREIGN PATENT DOCUMENTS

| | | |
|---|---|---|
| CN | 202228006 | 5/2012 |
| FR | 2097870 | 3/1972 |
| GB | 1149478 | 4/1969 |
| SE | 415117 | 6/1977 |
| WO | WO 2010/092237 | 8/2010 |

METHOD FOR A DRILL SUPPORT ARRANGEMENT, DRILL SUPPORT ARRANGEMENT, VEHICLE COMPRISING A DRILL SUPPORT ARRANGEMENT AND COMPUTER PROGRAM PRODUCT

TECHNICAL FIELD

The present invention relates to a method pertaining to a drill support device. The invention also relates to a computer program product comprising program code for a computer to implement a method according to the invention. The invention also relates to a drill support device and a vehicle equipped with the drill support device.

BACKGROUND

Today, drilling rigs are used for different purposes to drill holes in mine drifts. For example, both blasting agent holes and holes for rock reinforcement by bolting are drilled.

Mechanized drilling equipment today comprises drill support devices to control the drill steel during collaring and to clamp the drill steel during so-called extension drilling. There are currently a number of different embodiments of said drill support devices.

Drill support devices are subject to large strains during operation. For example, the vibrations from the rock drill of the drilling equipment might affect the equipment negatively. Furthermore, major problems arise today with water and drill dust entering the bearings of the drill support devices. Along with vibrations, said water and drill dust cause rapid wear of bearings and drill bushings of the drill support devices. Said wear is associated with large costs for example for maintenance. Another disadvantage is that the drill steel may obtain impaired guiding when the equipment is worn, which of course affects the operation and the reliability in a negative way.

WO 2010/092237 describes a clamping device for a drill steel or a bolt, which clamping device comprises a first clamping arm and a second clamping arm rotatably mounted. Said clamping device comprises an actuator means for controlling a relative relationship between the first clamping arm and the second clamping arm.

SUMMARY OF THE INVENTION

An object of the present invention is to provide a new and advantageous method pertaining to a drill support device.

Another object of the invention is to provide a new and advantageous drill support device and a new and advantageous computer program for a drill support device.

Another object of the invention is to provide a drill support device, which minimizes play and wear at fixing points of drill support arms of the drill support device.

A further object of the present invention is to provide a drill support device, which is inexpensive and easy to manufacture.

A further object of the invention is to provide a drill support device, which is essentially play-free.

A further object of the invention is to provide a user-friendly method pertaining to a drill support device.

A further object of the invention is to provide an alternative method pertaining to a drill support device and an alternative drill support device.

These objects are achieved by a method pertaining to a drill support device according to claim 1.

According to an aspect of the invention there is provided a method pertaining to a drill support device comprising two relatively moveable drill support arms, wherein a support space is formed between opposite arm sections, in which a drill steel is adapted to be guided and wherein said space is opened and closed by relative displacement of said sections. The method comprising the step of:

fixing at least one of said drill support arms partly by sealingly clamping said drill support arm between on the one side a support element and on the other side a housing section, which accommodates a hydraulic cylinder with a hydraulic piston, on which hydraulic cylinder said drill support arm is revolvingly mounted, and partly by displacing the housing section in relation to said drill support arm and clamping said drill support arm between the housing section and the support element by means of a screw means connected to the housing section and the hydraulic piston.

According to an aspect of the invention there is provided a method pertaining to a drill support device comprising two relatively movable drill support arms, wherein a support space is formed between opposite arm sections, in which a drill steel is adapted to be guided and wherein said space is opened and closed by relative displacement of said sections. The method comprising the step of:

fixing at least one of said drill support arms by sealingly clamping between on the one side a support element and on the other side a housing section, which accommodates a hydraulic cylinder with a hydraulic piston, on which hydraulic cylinder said drill support arm is revolvingly mounted, wherein said drill support arm is clamped by means of a screw means, by which the housing section is displaceable.

An advantage of the axially actuated drill support arms with high compressive force is that the bearings of the drill support arms become rigid, so that the drill dust and water not to any significant extent can penetrate into the bearings.

According to an embodiment, said drill support arms are composed of precision cut plates, which advantageously allow simple and inexpensive manufacturing of the drill support arms for different drill steel diameters.

Said screw means may enter in said hydraulic cylinder and be screwed in the piston of the hydraulic cylinder for prestressing of a spring arrangement acting in the hydraulic cylinder between the piston of the cylinder and a section of the hydraulic cylinder facing said piston for prestressed clamping of said drill support arm. Hereby is achieved a user-friendly method according to the invention wherein no expensive special tools are required to clamp said drill support arm.

Said clamping of the drill support arm may be reduced by means of a hydraulic pressure against said cylinder piston to at least partly overcome said prestress. Hereby is achieved a robust and user-friendly method wherein a compressing force acting on the drill support arm in an accurately controlled manner may be reduced to allow movement of said drill support arm.

Said hydraulic pressure may be controlled to achieve revolvability of said drill support arm while maintaining a sealing contact of the drill support arm with the support element and the housing section, respectively.

The method may comprise the step of:

opening and closing said space by relative displacement of said sections, wherein one drill support arm is fixed and the other drill support arm is revolving around the hydraulic cylinder.

The method may comprise the step of:

actuator means being affected for revolving the at least one drill support arm around the hydraulic cylinder.

Said hydraulic pressure may be optimized to achieve the revolvability of said drill support arm while maintaining good sealing in the contact of the drill support arm with the support element and the housing section respectively. Hereby is efficiently achieved a desirable function while keeping wear caused by water and drill dust at a bearing of the drill support arm to a minimum.

The method may comprise the step of:

opening and closing said space by relative displacement of said sections, wherein one of the drill support arms is fixed and the other drill support arm is movable.

The method may comprise the step of:

affecting actuator means to move at least one drill support arm.

According to an aspect of the invention there is provided a drill support device comprising two mutually movable drill support arms, wherein a support space is formed between opposite arm sections, in which a drill steel is adapted to be guided and wherein said space is opened and closed by relative displacement of said sections. The drill support device comprising:

means for fixing at least one of said drill support arms by sealingly clamping said drill support arm between on the one side a support element and on the other side a housing section, which accommodates a hydraulic cylinder with a hydraulic piston, on which hydraulic cylinder said drill support arm is revolvingly mounted, wherein said means for fixing at least one of said drill support arms comprises a screw means connected to the housing section and the hydraulic piston, wherein the housing section is displaceably arranged relative to said drill support arm and arranged to clamp said drill support arm between the housing section and the support element by means of the screw means.

According to an aspect of the invention there is provided a drill support device comprising two relatively movable drill support arms, wherein a support space is formed between opposite arm sections, in which a drill steel is adapted to be guided and wherein said space is opened and closed by relative displacement of said sections. The drill support device comprising:

means for fixing at least one of said drill support arms by sealingly clamping between on the one side a support element and on the other side a housing section, which accommodates a hydraulic cylinder with a hydraulic piston, on which hydraulic cylinder said drill support arm is revolvingly mounted, wherein said means for fixing at least one of said drill support arms comprises a screw means, by which the housing section is displaceable to achieve said clamping.

In the drill support device, said screw means may be arranged to enter in said hydraulic cylinder and be screwed in the piston of the hydraulic cylinder for prestressing of a spring arrangement acting in the hydraulic cylinder between the piston of the cylinder and a section of the hydraulic cylinder facing said piston, to prestressedly clamp said drill support arm.

The drill support device may comprise:

means for reducing said clamping of the drill support arm by means of a hydraulic pressure against said cylinder piston for at least partly overcome said prestress.

The drill support device may comprise:

means for controlling said hydraulic pressure to achieve revolvability of said drill support arm while maintaining the sealing contact of the drill support arm with the support element and the housing section respectively.

The drill support device may comprise:

means for opening and closing said space by relative displacement of said sections, wherein the one drill support arms is fixedly arranged and the other drill support arm is revolvingly arranged around the hydraulic cylinder.

The drill support device may comprise:

actuator means for revolving the at least one drill support arm around the hydraulic cylinder.

The drill support device may comprise:

means for optimizing said hydraulic pressure to achieve revolvability of said drill support arm while maintaining good sealing in the contact of the drill support arm with the support element and the housing section respectively.

The drill support device may comprise:

means for opening and closing said space by relative displacement of said sections, wherein one of the drill support arms is fixed and the other drill support arm is moveable.

The drill support device may comprise:

actuator means for moving at least one drill support arm.

According to an aspect of the invention, a vehicle is provided comprising the inventive drill support device.

Said vehicle may be a drilling rig.

According to an aspect of the present invention there is provided a computer program for a drill support device comprising two mutually movable drill support arms, wherein a support space is formed between opposite arm sections, in which a drill steel is adapted to be guided and wherein said space is opened and closed by relative displacement of said sections, wherein said computer program comprises program code stored on a, by a computer readable, medium for causing an electronic control unit or another computer connected to the electronic control unit to perform the steps according to any of the claims 1-6.

According to an aspect of the present invention there is provided a computer program for a drill support device comprising two relatively movable drill support arms, wherein a support space is formed between opposite arm sections, in which a drill steel is adapted to be guided and wherein said space is opened and closed by relative displacement of said sections, wherein said computer program comprises program code for causing an electronic control unit, or another computer connected to the electronic control unit to perform the steps according to any of claims 1-6.

According to an aspect of the invention there is provided a computer program product comprising a program code stored on a, by a computer readable, medium for performing the method steps according to any of claims 1-6, when said computer program is run on an electronic control unit or another computer connected to the electronic control unit.

Further objects, advantages and novel features of the present invention will become apparent to those skilled in the art from the following details, as well as by practice of the invention. While the invention is described below, it should be apparent that the invention is not limited to the specific details described. Those skilled in the art having access to the teachings herein will recognize additional applications, modifications and incorporations in other fields, which are within the scope of the invention.

BRIEF DESCRIPTION OF THE DRAWINGS

For a more complete understanding of the present invention and further objects and advantages thereof, reference is now made to the following detailed description to be read together with the accompanying drawings, wherein same references refer to the same parts in the various figures, and in which.

DETAILED DESCRIPTION OF THE DRAWINGS

Figure 1:
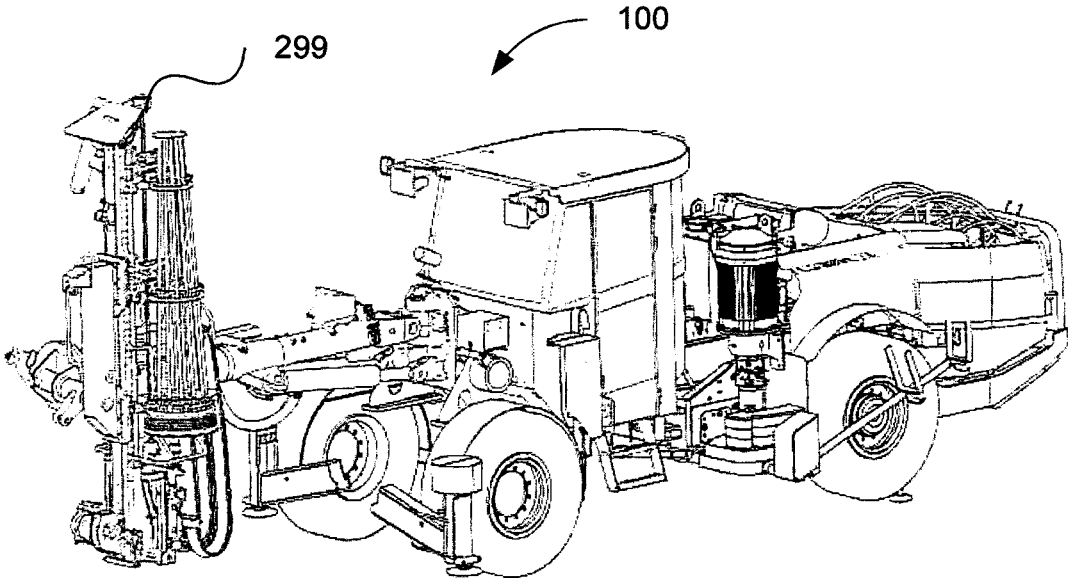
FIG. 1 schematically illustrates a vehicle, according to an embodiment of the invention.

Referring to FIG. 1, a vehicle 100 is shown. The exemplified vehicle 100 is according to an embodiment a so-called drilling rig for mining. The vehicle 100 may be a motor vehicle with 4, 6 or 8 wheels, wherein a suitable number of drive wheel sets are arranged at the vehicle 100.

The vehicle 100 is provided with a bolting configuration 299 comprising the inventive drill support device. The drill support device is described in further detail with reference to for example FIGS. 3*a*-3*e* below.

The vehicle 100 may be operator-controlled, wherein one or more operators may be on board the vehicle during propulsion of the vehicle. According to an alternative the vehicle 100 is remote-controlled, wherein one or more operators may be stationed at a control center located above ground. According to an alternative, the vehicle is arranged for autonomous control.

Herein the term "link" relates to a communication link, which may be a physical line such as an opto-electronic communication line, or a non-physical line such as a wireless connection, for example a radio or microwave link.

Figure 2:
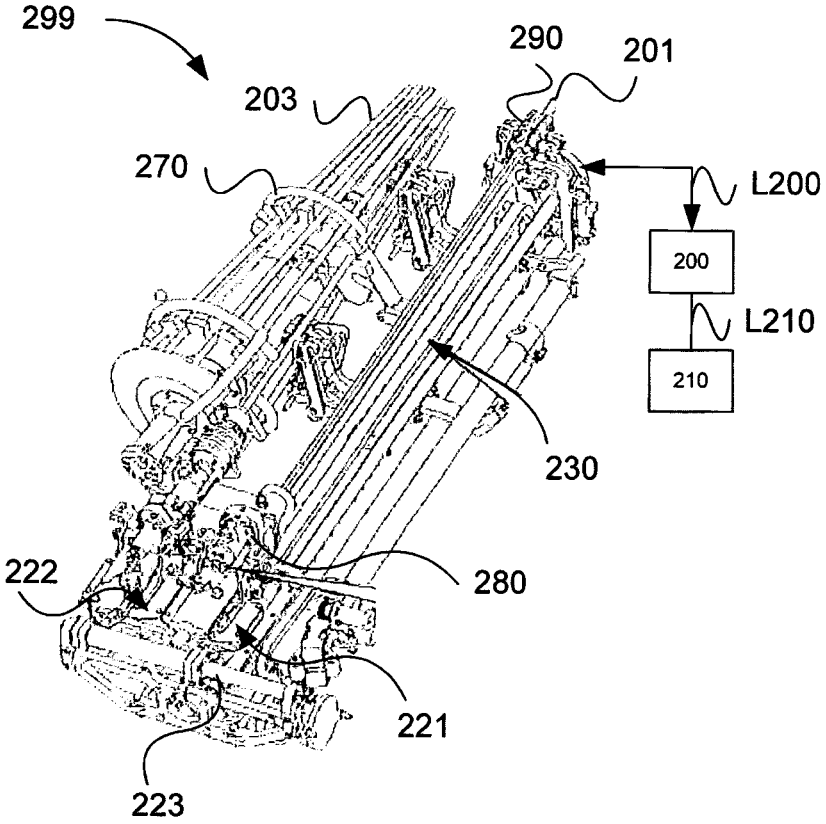
FIG. 2 schematically illustrates a bolting device, according to an embodiment of the invention.

FIG. 2 shows a device 299 for bolting. The device 299 is arranged on the vehicle 100 which is described with reference to FIG. 1.

The device 299 comprises a feed beam 230 along which a first carriage 221 and a second carriage 222 are arranged to alternately be used during operation of the device 299. In FIG. 2, the first carriage 221 is in position for operation. Next to said first carriage 221 a second carriage 222 is arranged. Said second carriage 222 may be brought into position for operation by switching means 223. Said switching means 223 may comprise one or more switching cylinders. Said switching means 223 are arranged to switch between said first carriage 221 and said second carriage 222 to achieve desired functionality of the device.

Said first carriage 221 is arranged to hold a drill steel 201. Said drill steel 201 may be an extension drill steel for drilling relatively deep holes. Said second carriage 222 is arranged to hold a bolt 203 for insertion in a drilled hole for rock reinforcement.

The device 299 comprises a drill support device 290. Said drill support device 290 is arranged, when applicable, to hold a drill steel 201 when drilling. Said drill support device 290 is described in further detail with reference to FIGS. 3*a*-3*e*.

The device 299 comprises drive means 280 for driving said drill steel 201 during drilling. Said drive means 280 may be a rock drill of appropriate dimension and driving power.

The device 299 comprises a bolt magazine 270. Said bolt magazine 270 is arranged at a first side of the device 299. Said first magazine 270 is arranged to detachably hold a number of bolts 203. Said bolts 203 may, where applicable, automatically be brought into operative engagement by being attached to the second carriage 222. It should be noted that said bolts 203 may be of mutually different sizes and types. Said bolts 203 may include fastening means such as barb means or anchor devices, or other suitable means for firmly attaching said bolts in drilled holes.

The device comprises drive means (not shown) for moving said first carriage 221 and said second carriage 222 respectively along the feed beam 230. Said drive means may include a motor and drive chain.

The device 299 comprises a first control unit 200. The first control unit 200 is arranged to automatically control operation of the device 299. The first control unit 200 is arranged to control the operation of parts included in the device 299, for example, said drill support device 290, said drive means and said rock drill 280.

A second control unit 210 is arranged for communication with the first control unit 200 via a link L210. The second control unit 210 may be detachably connected to the first control unit 200. The second control unit 210 may be an external control unit to the vehicle 100. The second control unit 210 may be arranged to perform the inventive method steps of the invention. The second control unit 210 may be used to load software into the first control unit 200, particularly software for performing the inventive method. The second control unit 210 may alternatively be arranged for communication with the first control unit 200 via an internal network in the vehicle. The second control unit 210 may be arranged to perform generally identical functions as the first control unit 200.

FIG. 2 illustrates only one link L200, which is arranged for communication with a part of the device 299. According to this example is achieved a possibility for the first control unit 200 to control the operation of said drill support device 290 by means of control signals via said link L200. Hereby is the first control unit 200 arranged to open and close respectively the drill support arms of the drill support means 290 by affecting actuator means and a hydraulic device for adjusting a clamping pressure of the drill support device. The device 299 may comprise a number of links for controlling the various constituent parts of the device 299. These links have however been omitted to make FIG. 2 clear.

According to an example the first control unit 200 is arranged to control the operation of said drill support device 290 by means of appropriate hydraulic equipment (not shown). According to an example the first control unit is arranged to control the operation of said drill support device by means of appropriate electromechanical equipment (not shown).

An operator may by means of actuator means (not shown) signal connect to the first control unit 200 and actively control the device 299 for bolting, and specifically control the operation of said drill support device 290.

According to an alternative an operator may initiate and monitor the operation of said drill support device 290 by means of a computer (not shown) and appropriate user interface, according to the inventive method. Said computer is signal connected to the first control unit 200.

Figure 3A:
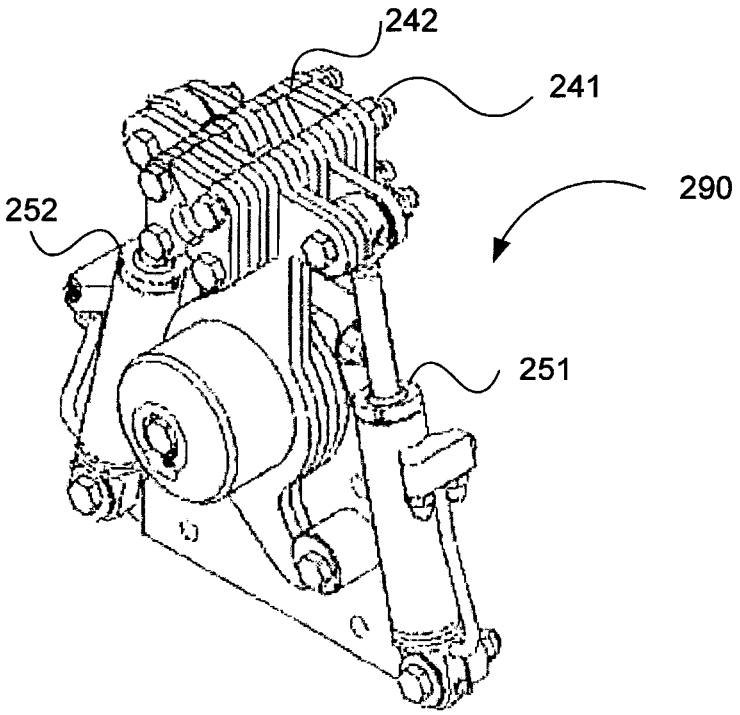
FIG. 3*a* schematically illustrates a drill support device, according to an embodiment of the invention.

FIG. 3*a* schematically illustrates a drill support device 290, according to an embodiment of the invention.

According to this embodiment, the drill support device 290 is provided with a first drill support arm 241 and a second drill support arm 242. The drill support device 299 is according to FIG. 3*a* in a closed state, wherein a drill steel 201 (not shown) may be positioned and guided in a desirable way.

The drill support device 299 comprises a first actuator means 251, which is arranged to revolvingly move the first drill support arm 241. Said first drill support arm 241 is rotatably mounted around a cylinder axis of the drill support device 290. Said first actuator means 251 may be a hydraulically controlled cylinder member.

The drill support device 299 comprises a second actuator means 252, which is arranged to revolvingly move the second drill support arm 242. Said second drill support arm 242 is rotatably mounted around a cylinder axis of the drill support device. Said second actuator means 252 may be a hydraulically controlled cylinder member.

Said first drill support arm 241 and said second drill support arm 242 may be configured with a number of die-cut plates, which plates or sheets may be joined by suitable means and hereby form a body constituting said respective drill support arm. Said sheets may have a suitable thickness, for example 3 or 5 millimeters.

The first control unit 200 is arranged to control operation of said first actuator means 251 and said second actuator means 252. The first control unit 200 is arranged to control operation of said first actuator means 251 and said second actuator means 252 independently. Hereby, either the first drill support arm 241 or the second drill support arm 242 may be rotated around said cylinder axis to open or close the drill support device 290.

Figure 3B:
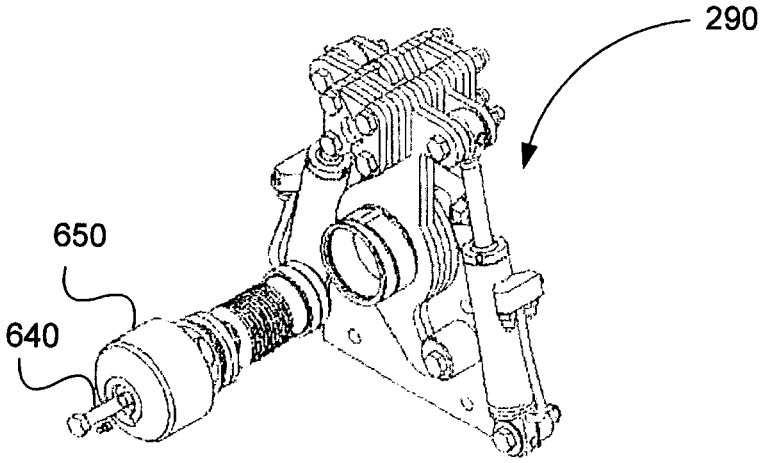
FIG. 3*b* schematically illustrates a drill support device, according to an embodiment of the invention.

FIG. 3*b* schematically illustrates a drill support device 290, according to an embodiment of the invention.

Hereby is illustrated a housing 650, which is arranged to be fastened to the drill support device 299 by means of a screw 640.

Figure 3C:
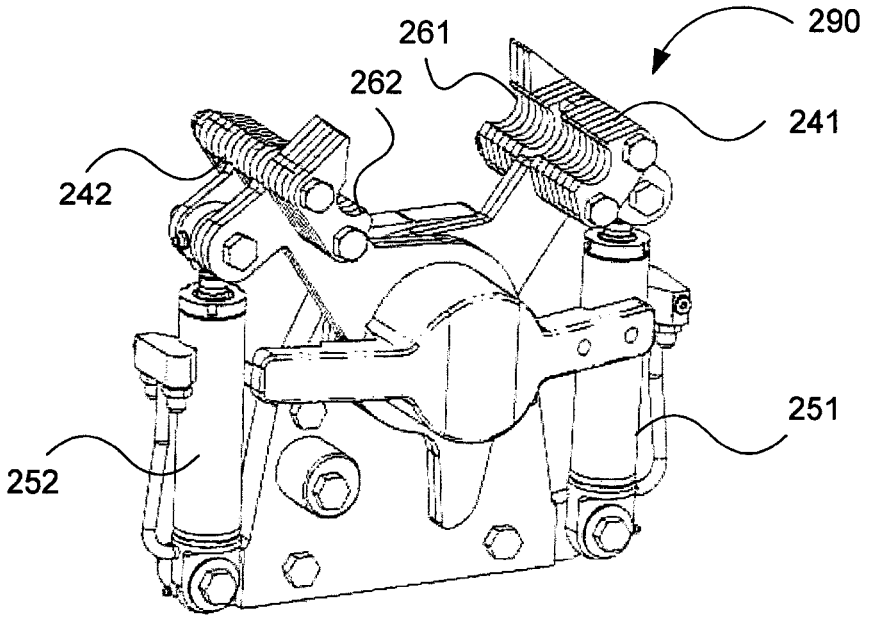
FIG. 3*c* schematically illustrates a drill support device, according to an embodiment of the invention.

FIG. 3*c* schematically illustrates a drill support device 290, according to an embodiment of the invention.

According to this embodiment, the drill support device 290 is provided with said first drill support arm 241 and said second drill support arm 242. The drill support device 290 according to FIG. 3*c* is in an open state, wherein a drill steel 201 (not shown) is not held by the first drill support arm 241 and the second drill support arm 242. This can be advantageous during drilling where a bore crown of a drill steel 201 has penetrated the rock to a desirable extent. This may also be advantageous and necessary when changing a drill steel 201 or when extending a drill steel 201.

The drill support 290 comprises said first actuator means 251, which is arranged to revolvingly move the first drill support arm 241. Said first drill support arm 241 is rotatably mounted around a cylinder axis of the drill support device. Said first actuator means 251 may be a hydraulically controlled cylinder member.

The drill support device 290 comprises said second actuator means 252, which is arranged to revolvingly move the second drill support arm 242. Said second drill support arm 242 is rotatably mounted around a cylinder axis of the drill support device. Said second actuator means 252 may be a hydraulically controlled cylinder member.

Said first drill support arm 241 is provided with a recess 261 which is generally semicircular shaped. Said second drill support arm 242 is provided with a recess 262, which is generally semicircular shaped. In a closed state, said first drill support arm 241 and said second 242 drill support arm are thus forming a generally circular hole, which is dimensioned to hold said drill steel 201 suitably with regard to guiding and friction forces.

It should be noted that said first drill support arm 241 and said second drill support arm 242 may be arranged with a respective recess, which in a closed state forms a suitable hole for holding said drill steel 201, for example a hexagonal or octagonal hole.

Figure 3D:
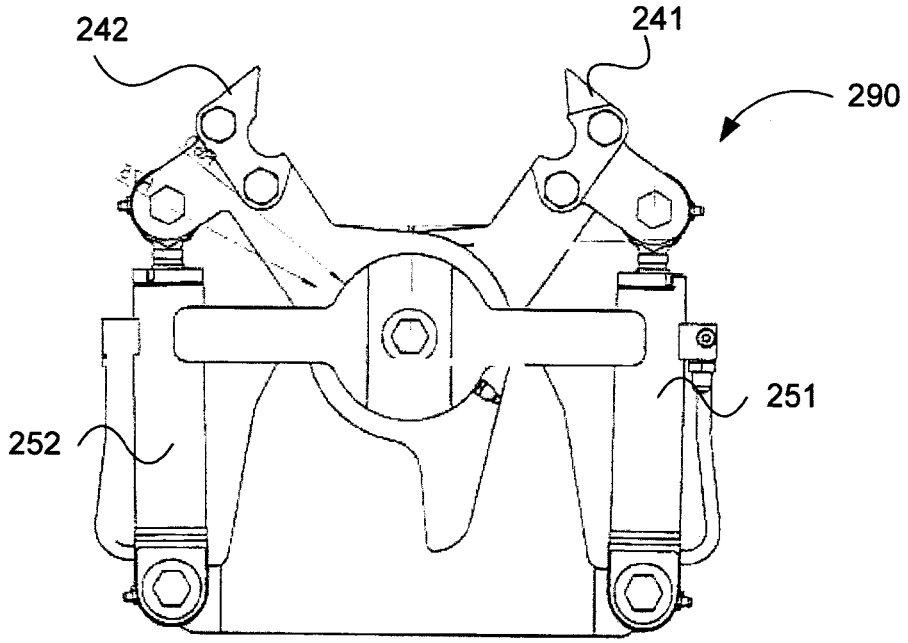
FIG. 3*d* schematically illustrates a drill support device, according to an embodiment of the invention.

FIG. 3*d* schematically illustrates a drill support device 290, according to an embodiment of the invention.

According to this embodiment, the drill support device 290 is provided with said first drill support arm 241 and said second drill support arm 242. The drill support device 290 according to FIG. 3*d* is in an open state, wherein a drill steel 201 (not shown) is not held by the first drill support arm 241 and the second drill support arm 242.

The drill support device 290 comprises said first actuator means 251, which is arranged to revolvingly move the first drill support arm 241. Said first drill support arm 241 is rotatably mounted around a cylinder axis of the drill support device.

The drill support device 290 comprises said second actuator means 252, which is arranged to revolvingly move the second drill support arm 242. Said second drill support arm 242 is rotatably mounted around a cylinder axis of the drill support device.

Figure 3E:
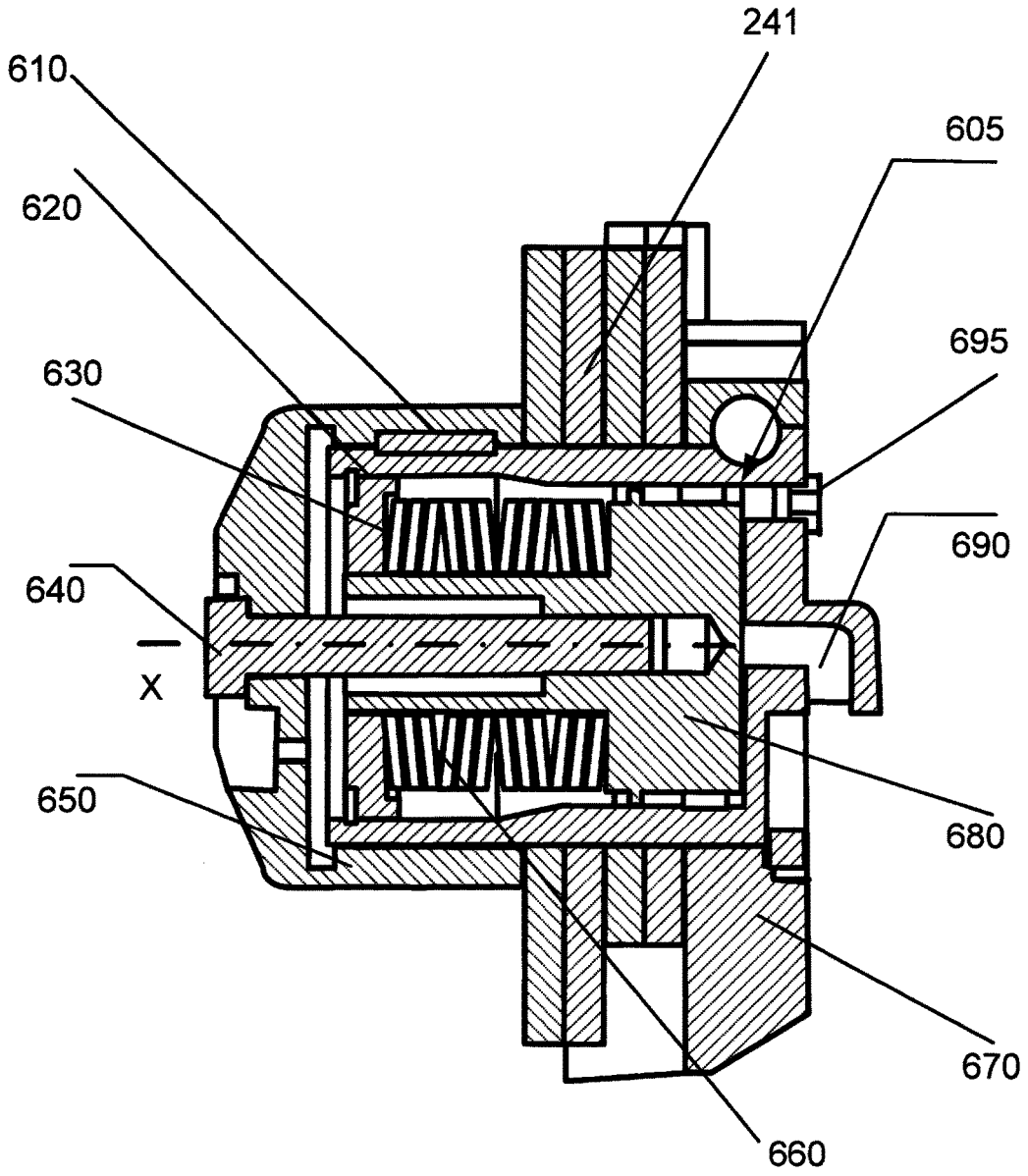
FIG. 3*e* schematically illustrates a drill support device, according to an embodiment of the invention.

FIG. 3*e* schematically illustrates a drill support device 290, according to an embodiment of the invention.

The drill support device 290 comprises two mutually movable drill support arms. According to this example is however only a section of the first drill support arm 241 illustrated. The two movable drill support arms 241 and 242 are arranged to form a support space between opposite arm sections, in which a drill steel 201 is adapted to be guided and wherein said space is opened and closed by relative displacement of said sections, as described above.

The drill support device 290 comprises means for fixing at least one of said drill support arms 241 and 242 by sealingly clamping between on the one side a support element 670 and on the other side a housing section 650. Said support element 670 may also be denominated frame. Said housing section 650 may also be denominated housing.

The housing section 650 accommodates a hydraulic cylinder 605 with a hydraulic piston 680. Said first drill support arm 241 and said second drill support arm 242 are revolvingly mounted on said hydraulic cylinder 605.

A screw means 640 is arranged for fixing at least one of said drill support arms 241 and 242, by which screw means 640 said housing section 650 is displaceable to achieve clamping of the drill support arms 241 and 242 between said housing section 650 and said support element 670.

Said screw means 640 is arranged to enter in said hydraulic cylinder 605 and to be screwed in a piston 680 of the hydraulic cylinder 605 for prestressing of a spring arrangement 660 acting in the hydraulic cylinder 605 between the piston 680 of the cylinder and a section of the hydraulic cylinder 605 facing said piston 680 to prestressedly clamp said first drill support arm 241 and 242.

The drill support device 290 is arranged with a passage 690 for a hydraulic fluid such as hydraulic oil. The bolting device 299 is hereby equipped with a container (not shown) to hold said hydraulic fluid and drive means and suitable conduits for supplying said fluid from said container to said passage, and vice versa. The first control unit 200 is arranged to in a controlled manner supply said fluid through said passage 690 to affect the drill support device 290, such that a clamping force on said first drill support arm 241 and said second drill support arm 242 is reduced in a desired manner. Hereby is the movement of said first drill support arm 241 and said second drill support arm 242 enabled, wherein the opening and closing of said drill support device 290 may be achieved.

A ventilating valve 695 is arranged at the support element 670 to enable manual venting of the drill support device 290.

Hereby is thus provided means for reducing said clamping of the drill support arms 241 and 242 by means of a hydraulic pressure against said cylinder piston 680 to at least partly overcome said prestress.

Said first control unit 200 is arranged for optimizing a hydraulic pressure at the drill support device 290 to achieve revolvability of said drill support arms 241 and 242 while maintaining a good sealing in the contact of the drill support arm with the support element and the housing section respectively.

According to an aspect of the invention arises a clamping force axially on said drill support arm 241 when said clamping screw 640 is tightened and tensions the spring assembly 660 against said plate 630, wherein said housing 650 presses the drill support arm 241 against said frame 670.

In order to reduce said clamping force so that said first drill support arm 241 can be moved to open the drill support device 290, said hydraulic fluid may be supplied into the drill support device 290 to affect an axial position of said piston 680, wherein the spring assembly 660 is compressed and causes a reduced clamping force between said housing 650 and frame 670.

According to an embodiment of the present invention said spring assembly 660 may be replaced by a hydraulic spring.

A wedge assembly 610 is according to an embodiment arranged to prevent rotation of the housing 650 around an axis X.

Figure 4A:
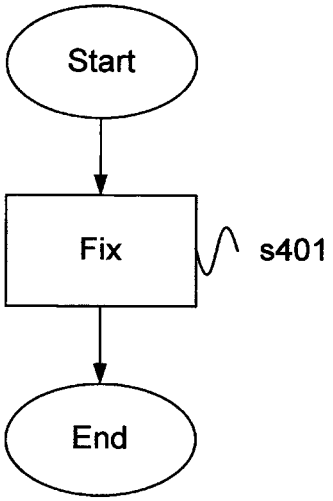
FIG. 4*a* schematically illustrates a flowchart for a method, according to an embodiment of the invention.

FIG. 4*a* schematically illustrates a flowchart of a method pertaining to a drill support device comprising two relatively movable drill support arms, wherein a support space is formed between opposite arm sections, in which a drill steel is adapted to be guided and wherein said space is opened and closed by relative displacement of said sections, according to an embodiment of the invention. The method comprises a first method step S401. The step S401 comprising the step of:

fixing at least one of said drill support arms by sealingly clamping between on the one side a support element and on the other side a housing section, which accommodates a hydraulic cylinder with a hydraulic piston, on which hydraulic cylinder said drill support arm is revolvingly mounted, wherein said drill support arm is clamped by means of a screw means, by which the housing section is displaceable. After step S401 the method is ended.

Figure 4B:
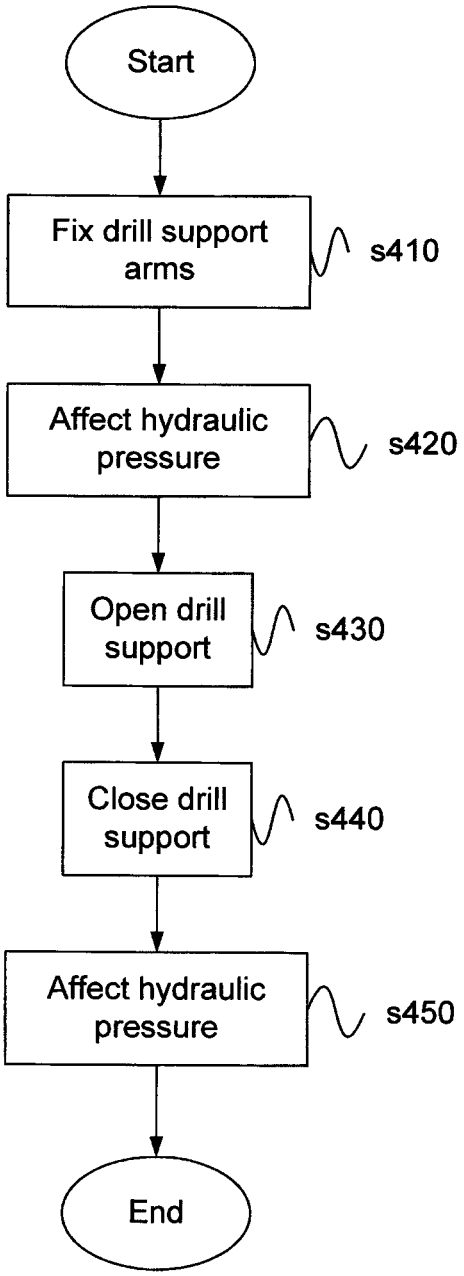
FIG. 4*b* schematically illustrates in further detail a flowchart for a method, according to an embodiment of the invention.

FIG. 4*b* schematically illustrates a flowchart of a method pertaining to a drill support device comprising two relatively movable drill support arms, wherein a support space is formed between opposite arm sections, in which a drill steel is adapted to be guided and wherein said space is opened and closed by relative displacement of said sections, according to an embodiment of the invention.

The method comprises a first method step S410. The method step S410 comprises the step of manually fixing said drill support arm by clamping by means of a screw means 640, by which the housing section 650 is displaceable at the drill support device 290. Said fixing may be achieved by a manual screwdriver or an electric screwdriver. After the method step S410 is a subsequent method step S420 performed.

The method step S420 comprises the step of affecting a hydraulic pressure of the drill support device 290. Hereby, the hydraulic pressure may be increased by supplying said fluid through said passage 690. The hydraulic pressure may be increased to such an extent that at least one of the drill support arms 241 and 242 can be rotated around said cylinder 605 to open the drill support device 290. After the method step S420 is a subsequent method step s430 performed.

The method step s430 comprises the step of opening the drill support device 290 by means of dedicated actuator means 251 and 252. After the method step s430 is a subsequent method step s440 performed.

The method step s440 comprises the step of closing the drill support device 290 by means of dedicated actuator means 251 and 252. After the method step s440 is a subsequent method step s450 performed.

The method step S450 comprises the step of affecting the hydraulic pressure of the drill support device 290. Hereby, the hydraulic pressure may be reduced by the filling of said fluid through said passage 690. The hydraulic pressure may be reduced to such an extent that the drill support arms 241 and 242 cannot be easily rotated around said cylinder 605. After the method step S450, the method is ended.

Figure 5:
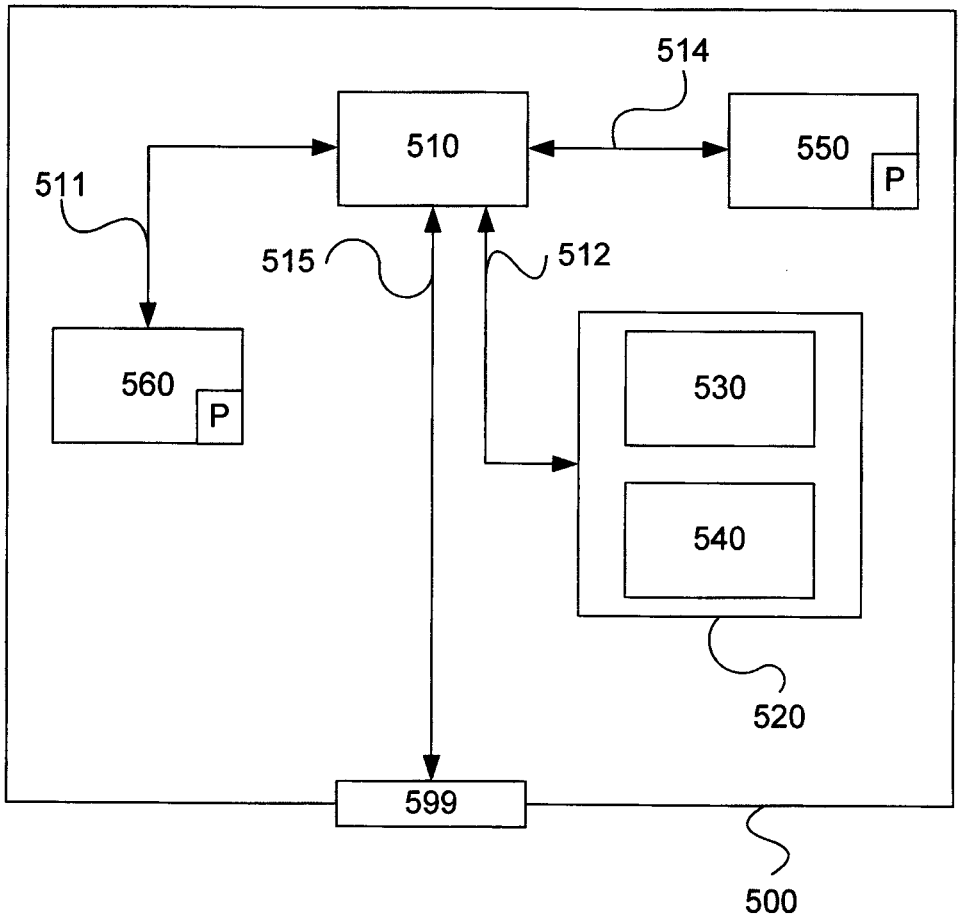
FIG. 5 schematically illustrates a computer, according to an embodiment of the invention.

FIG. 5 shows a diagram of an embodiment of a device 500. The control units 200 and 210 described with reference to FIG. 2 may in an embodiment comprise the device 200. The device 500 comprises a non-volatile memory 520, a data processing unit 510 and a read/write memory 550. The non-volatile memory 520 has a first memory portion 530 wherein a computer program, such as an operating system, is stored for controlling the function of the device 500. The device 500 further comprises a bus controller, a serial communication port, I/O-means, an A/D converter, a time- and date input and transferring unit, an event counter and interrupt controller (not shown). The non-volatile memory 520 also has a second memory portion 540.

There is provided a computer program P comprising routines to open and close said drill support device 290 according to an aspect of the inventive method. The program P comprises routines for adjusting a hydraulic pressure of the drill support device 290 to hereby control said clamping force acting on at least one of the drill support arms 241 and 242. The program P comprises routines for fixing at least one of said drill support arms 241 and 242 by sealingly clamping between on the one side said support element 670 and on the other side said housing section 650, which accommodates said hydraulic cylinder 605 with a hydraulic piston 680, on which hydraulic cylinder 605 said drill support arms 241 and 242 are revolvingly mounted, wherein said drill support arms are clamped by means of a screw means 640, by which the housing section 650 is displaceable, in accordance with the inventive method. The program P may be stored in an executable manner or in a compressed manner in a memory 560 and/or in a read/write memory 550.

When it is described that the data processing unit 510 performs a certain function it should be understood that the data processing unit 510 performs a certain part of the program which is stored in the memory 560 or a certain part of the program stored in the read/write memory 550.

The data processing device 510 may communicate with a data port 599 via a data bus 515. The non-volatile memory 520 is adapted to communicate with the data processing unit 510 via a data bus 512. The separate memory 560 is adapted to communicate with the data processing unit 510 via a data bus 511. The read/write memory 550 is arranged to communicate with the data processing unit 510 via a data bus 514. To the data port 599 may, for example, links L200 and L210 be connected (see FIG. 2).

When data is received at the data port 599 it is temporarily stored in the second memory portion 540. When the received input data is temporarily stored, the data processing unit 510 is prepared to perform execution of code in a manner described above. According to an embodiment, the signals received at the data port 599 comprise information on an existing hydraulic pressure of the drill support device 290. According to an embodiment, the signals received at the data port 599 comprise information on an initial clamping force caused by the screw means 640. Said information may be measured with therefore dedicated means or manually be fed into the first control unit 200 by a suitable communication means, such as a touch screen. The received signals at the data port 599 may be used by device 500 for controlling a hydraulic pressure of the drill support device 290 as appropriate.

Parts of the methods described herein may be performed by the device 500 by means of the data processing unit 510 running the program stored in the memory 560 or the read/write memory 550. When the device 500 runs the program, the herein described methods are executed.

The previous description of the preferred embodiments of the present invention has been provided for the purpose of illustration and description. It is not intended to be comprehensive or to limit the invention to the described variants. Obviously, many modifications and variations will become apparent to the skilled person. The embodiments were chosen and described to best explain the principles of the invention and its practical applications, thereby allowing persons skilled in the art to understand the invention for various embodiments and with the various modifications suitable for the intended use.

The invention claimed is:

1. A method pertaining to a drill support device (290) comprising two relatively movable drill support arms (241; 242), wherein a support space is formed between opposite arm sections (261, 262), in which a drill steel (201) is adapted to be guided and wherein said space is opened and closed by relative displacement of said sections (261, 262);

wherein said method comprises the step of:

fixing (S401) at least one of said drill support arms (241; 242) partly by sealingly clamping said drill support arm (241; 242) between on the one side a support element (670) and on the other side a house section (650), which accommodates a hydraulic cylinder (605) with a hydraulic piston (680), on which hydraulic cylinder (605) said drill support arm (241; 242) is revolvingly mounted, and partly by displacing the housing section (650) relative to said drill support arm (241; 242) and clamping said drill support arm (241; 242) between the housing section (650) and the support element (670) by means of a screw means (640) connected to the housing section (650) and the hydraulic piston (680).

2. The method according to claim 1, wherein said screw means (640) enters in said hydraulic cylinder (605) and is screwed in the piston (680) of the hydraulic cylinder for prestressing of a spring arrangement (660) acting in the hydraulic cylinder (605) between the piston (680) of the cylinder and a section of the hydraulic cylinder (605) facing said piston (680) to prestressedly clamp said drill support arm (241; 242).

3. The method according claim 2, wherein said clamping of the drill support arm (241; 242) is reduced by means of a hydraulic pressure against said cylinder piston (680), to at least partly overcome said prestress.

4. The method according to claim 2 wherein the steps of said method are performed by a computer program (P) for a drill support device (290) comprising two relatively movable drill support arms (241; 242), wherein a support space is formed between opposite arm sections (261, 262), in which a drill steel (201) is adapted to be guided and wherein said space is opened and closed by relative displacement of said sections (261, 262), wherein said computer program (P) comprises program code stored on a, or by a, computer readable, medium for causing an electronic control unit (200; 500) or another computer (210; 500) connected to the electronic control unit (200; 500).

5. The method according to claim 2 wherein the steps of said method are performed by a A computer program product comprising a program code stored on a, or by a, computer readable, medium, when said computer program is run on an electronic control unit (200; 500) or another computer (210; 500) connected to the electronic control unit (200; 500).

6. The method according claim 1, wherein said clamping of the drill support arm (241; 242) is reduced by means of a hydraulic pressure against said cylinder piston (680), to at least partly overcome said prestress.

7. The method according to claim 1, wherein said hydraulic pressure is controlled to achieve revolvability of said drill support arm (241; 242) while maintaining a sealing contact of the drill support arm with the support element (670) and the housing section (650) respectively.

8. The method according to claim 1, comprising the step of:

opening (s430) and closing (s440) said space by relative displacement of said sections (261, 262), wherein the one drill support arms is fixed and the other drill support arm is revolving around the hydraulic cylinder (605).

9. The method according to claim 1, comprising the step of:

affecting actuator means (251; 252) to revolve said at least one drill support arm (241; 242) around the hydraulic cylinder (605).

10. The method according to claim 1 wherein the steps of said method are performed by a computer program (P) for a drill support device (290) comprising two relatively movable drill support arms (241; 242), wherein a support space is formed between opposite arm sections (261, 262), in which a drill steel (201) is adapted to be guided and wherein said space is opened and closed by relative displacement of said sections (261, 262), wherein said computer program (P) comprises program code stored on a, or by a, computer readable, medium for causing an electronic control unit (200; 500) or another computer (210; 500) connected to the electronic control unit (200; 500).

11. The method according to claim 1 wherein the steps of said method are performed by a computer program product comprising a program code stored on a, or by a, computer readable, medium, when said computer program is run on an electronic control unit (200; 500) or another computer (210; 500) connected to the electronic control unit (200; 500).

12. A drill support device (290) comprising two relatively movable drill support arms (241; 242), wherein a support space is formed between opposite arm sections (261, 262), in which a drill steel (201) is adapted to be guided and wherein said space is opened and closed by relative displacement of said sections (261, 262);

wherein:

means (640, 650, 670, 680) for fixing at least one of said drill support arms (241; 242) by sealingly clamping said drill support arm (241; 242) between, on the one side a support element (670) and on the other side a house section (650), which accommodates a hydraulic cylinder (605) with a hydraulic piston (680), on which hydraulic cylinder (605) said drill support arm (241; 242) is revolvingly mounted, wherein said means (640, 650, 670) for fixing at least one of said drill support arms (241; 242) comprises a screw means (640) connected to the housing section (650) and the hydraulic piston (680), wherein said housing section (650) is displaceably arranged relative to said drill support arm (241; 242) and arranged to clamp said drill support arm (241; 242) between the housing section (650) and the support element (670) by means of the screw means (640).

13. The drill support device according to claim 12, wherein said screw means (640) is arranged to enter in said hydraulic cylinder (605) and is screwed in the piston (680) of the hydraulic cylinder for prestressing of a spring arrangement (660) acting in the hydraulic cylinder (605) between the piston (680) of the cylinder and a section of the hydraulic cylinder (605) facing said piston to prestressedly clamp said drill support arm (241; 242).

14. The drill support device according to claim 13, comprising:

means (690) for reducing said clamping of the drill support arm (241; 242) by means of a hydraulic pressure against said cylinder piston (680) to at least partly overcome said prestress.

15. The drill support device according to claim 12, comprising:

means (690) for reducing said clamping of the drill support arm (241; 242) by means of a hydraulic pressure against said cylinder piston (680) to at least partly overcome said prestress.

16. The drill support device according to claim 12, comprising:

means (200; 210; 500) for controlling said hydraulic pressure to achieve revolvability of said drill support arm (241; 242) while maintaining a sealing contact of the drill support arm with the support element (670) and the housing section (650) respectively.

17. The drill support device according to claim 12, comprising:

means (200; 210; 500; 251; 252) for opening and closing said space by relative displacement of said sections (261; 262), wherein one drill support arm is fixedly arranged and the other drill support arm is revolvingly arranged around the hydraulic cylinder (605).

18. The drill support device according to any claim 17, comprising:

actuator means (251; 252) for revolving the at least one drill support arm (241; 242) around the hydraulic cylinder (605).

19. A vehicle (100) comprising a drill support device (290) according to claim 12.

20. The vehicle according to claim 19, wherein said vehicle is a drilling rig.

* * * * *